US010995426B2

(12) United States Patent
Song et al.

(10) Patent No.: US 10,995,426 B2
(45) Date of Patent: May 4, 2021

(54) FLAME RETARDANT COMPOSITE FIBER AND PREPARATION METHOD THEREFOR

(71) Applicant: CHANGWON NATIONAL UNIVERSITY INDUSTRY ACADEMY COOPERATION CORPS, Changwon-si (KR)

(72) Inventors: Jung-il Song, Changwon-si (KR); Prabhakar Muchukota Narendra, Changwon-si (KR)

(73) Assignee: CHANGWON NATIONAL UNIVERSITY INDUSTRY ACADEMY COOPERATION CORPS, Changwon-si (KR)

( * ) Notice: Subject to any disclaimer, the term of this patent is extended or adjusted under 35 U.S.C. 154(b) by 0 days.

(21) Appl. No.: 16/707,590

(22) Filed: Dec. 9, 2019

(65) Prior Publication Data

US 2020/0115825 A1 Apr. 16, 2020

Related U.S. Application Data

(62) Division of application No. 15/745,469, filed as application No. PCT/KR2016/000624 on Jan. 21, 2016, now abandoned.

(30) Foreign Application Priority Data

Jul. 17, 2015 (KR) ..... 10-2015-0101470

(51) Int. Cl.
*D01F 1/07* (2006.01)
*D06M 15/267* (2006.01)
(Continued)

(52) U.S. Cl.
CPC ..... *D01F 1/07* (2013.01); *D01D 10/02* (2013.01); *D01F 1/10* (2013.01); *D01F 2/00* (2013.01);
(Continued)

(58) Field of Classification Search
USPC ..... 442/136; 428/292.1; 427/240, 242, 427/393.3, 372.2, 322
See application file for complete search history.

(56) References Cited

U.S. PATENT DOCUMENTS 5,156,890 A 10/1992 Rock
6,605,657 B1 * 8/2003 Favis ..... C08J 3/005 524/388
(Continued)

FOREIGN PATENT DOCUMENTS

KR 20-0192450 Y1 8/2000
KR 10-2005-0081806 A 8/2005
(Continued)

*Primary Examiner* — Lynda Salvatore
(74) *Attorney, Agent, or Firm* — Novick, Kim & Lee, PLLC; Jae Yoon Kim

(57) ABSTRACT

Provided is a method for preparing a flame-retardant composite fabric, the method sequentially including: a solution preparation step of mixing water with glycerol while heating them at a temperature of 60 to 80° C., thereby preparing a glycerol solution; a composite preparation step of adding powdery corn starch to the glycerol solution to obtain a glycerol/corn starch mixture, continuously stirring the glycerol/corn starch mixture, allowing the stirred glycerol/corn starch mixture to stand for a predetermined time, and then grinding the glycerol/corn starch mixture, thereby preparing a powdery thermoplastic starch composite; a powder application step of applying the powdery thermoplastic starch composite to a surface of a sheet-like flax fabric; and a hot-press molding step of subjecting the flax fabric with the thermoplastic starch composite applied thereto to compression molding using a hot press, thereby preparing a flame-retardant composite fabric; and also provides a flame-retardant composite fabric prepared thereby.

4 Claims, 5 Drawing Sheets

(51) Int. Cl.

| | |
|---|---|
| ***D06M 15/03*** | (2006.01) |
| ***D01F 1/10*** | (2006.01) |
| ***D01F 2/00*** | (2006.01) |
| ***D01D 10/02*** | (2006.01) |
| ***D06M 15/11*** | (2006.01) |

(52) U.S. Cl.
CPC ..... *D06M 15/03* (2013.01); *D06M 15/11* (2013.01); *D06M 15/267* (2013.01)

(56) References Cited

U.S. PATENT DOCUMENTS

| | | | | |
|---|---|---|---|---|
| 9,662,522 | B2 | 5/2017 | Liu et al. | |
| 2010/0285185 | A1* | 11/2010 | Thornton | C08L 3/02 426/132 |
| 2012/0315457 | A1 | 12/2012 | Zheng et al. | |
| 2014/0005299 | A1 | 1/2014 | Liao et al. | |

FOREIGN PATENT DOCUMENTS

| | | | |
|---|---|---|---|
| KR | 10-0867196 | B1 | 11/2008 |
| KR | 10-0980630 | B1 | 9/2010 |
| KR | 10-2010-0127077 | A | 12/2010 |
| KR | 10-2011-0127328 | A | 11/2011 |
| KR | 10-1180906 | B1 | 9/2012 |
| KR | 10-2014-0073008 | A | 6/2014 |
| KR | 10-2014-0073009 | A | 6/2014 |

* cited by examiner

FLAME RETARDANT COMPOSITE FIBER AND PREPARATION METHOD THEREFOR

CROSS-REFERENCE TO RELATED APPLICATIONS

This application is a divisional of U.S. application Ser. No. 15/745,469, abandoned on Oct. 7, 2020, which is a national stage application of PCT/KR2016/000624, filed on Jan. 21, 2016, which claims priority to KR10-2015-0101470, filed on Jul. 17, 2015, the disclosure of which is incorporated herein by reference in its entirety.

TECHNICAL FIELD

The present invention relates generally to a composite fabric, and more specifically to a novel type of composite fabric which is physically and chemically more durable while being environmentally friendly and which can also be used for fire protection through the provision of flame retardancy, and a preparation method therefor.

BACKGROUND ART

In general, the importance of personal safety against various fire hazards is gradually increasing as can be seen from deadly accidents attributable to fires, and thus the development of flame-retardant composite fabrics, which are applied to various types of clothing and bedding, is also increasing.

In particular, it is essential that fire protective clothing needs to be made of flame-retardant composite fabrics to reliably protect human bodies from the danger of flames. Such flame-retardant composite fabrics are imparted with flame retardancy mainly by polyester resins containing flame retardants copolymerized therein, as disclosed in various patent documents, including Korean Patent Nos. 10-0867196, 10-1038466, 10-1425999 and 10-1425996.

However, the above-described polyester resins can be imparted with flame retardancy by halogenated and non-halogenated compounds, in which the halogenated compounds have a problem in that they cause air pollution. In addition, the polyester resins also have a problem in that they are not environmentally friendly due to their low biodegradability.

For this reason, in recent years, there has been a growing demand for a flame-retardant composite fabric which is physically and chemically more durable and environmentally friendly.

DISCLOSURE

Technical Problem

The present invention has been conceived to overcome the above-described problems of the prior art, and an object of the present invention is to provide a novel type of composite fabric which is physically and chemically more durable while being environmentally friendly and which can also be used for fire protection through the provision of flame retardancy, and a preparation method therefor.

Technical Solution

In order to accomplish the above object, the present invention provides a flame-retardant composite fabric prepared by applying to the surface of a flax fabric a mixture of a powdery flame retardant and a thermoplastic starch composite including corn starch as a main component and then subjecting the flax fabric to compression molding using a hot press.

In this case, the thermoplastic starch composite may be prepared by mixing water with glycerol to prepare a glycerol solution, adding and mixing corn starch with the glycerol solution to obtain a glycerol/corn starch mixture, allowing the glycerol/corn starch mixture to stand for a predetermined time, and then grinding the glycerol/corn starch mixture.

Furthermore, the flame retardant may be a mixture of chitosan and ammonium polyphosphate.

In addition, the present invention also provides a method for preparing a flame-retardant composite fabric, the method sequentially including: a solution preparation step of mixing water with glycerol while heating them at a temperature of 60 to 80° C., thereby preparing a glycerol solution; a composite preparation step of adding powdery corn starch to the glycerol solution to obtain a glycerol/corn starch mixture, continuously stirring the glycerol/corn starch mixture, allowing the stirred glycerol/corn starch mixture to stand for a predetermined time, and then grinding the glycerol/corn starch mixture, thereby preparing a powdery thermoplastic starch composite; a powder application step of applying the powdery thermoplastic starch composite to a surface of a sheet-like flax fabric; and a hot-press molding step of subjecting the flax fabric with the thermoplastic starch composite applied thereto to compression molding using a hot press, thereby preparing a flame-retardant composite fabric.

In this case, the method of the present invention may further include, after the composite preparation step, a flame retardant addition step of adding a powdery flame retardant, prepared by mixing chitosan and ammonium polyphosphate together, to the powdery thermoplastic starch composite, prepared in the composite preparation step, to make a powdery thermoplastic starch composite/flame retardant mixture, and the powder application step may include applying the powdery thermoplastic starch composite/flame retardant mixture to the surface of the flax fabric.

Furthermore, the chitosan of the flame retardant may be used in an amount of 3 to 9 parts by weight.

Moreover, the hot-press molding step is performed by stacking sheets of the flax fabric with the thermoplastic starch composite applied thereto on a compression mold and then pressing the sheets at a pressure of 7 MPa or higher and a temperature of 120 to 160° C.

Advantageous Effects

The above-described flame-retardant composite fabric and preparation method therefor according to the present invention have the effect of providing an environmentally friendly composite fabric by preparing a composite fabric by means of biodegradable components.

In particular, the flame-retardant composite fabric and the preparation method therefor according to the present invention have the effect of providing a physically and chemically more durable composite fabric by including not only a thermoplastic starch composite containing corn starch as a main component but also a flax fabric as a fabric. The corn starch is readily available at low costs, and thus there can be achieved the effect of making it possible to prepare a composite fabric having excellent performance at low production costs.

In addition, the flame-retardant composite fabric and the preparation method therefor according to the present invention can provide a composite fabric imparted with flame retardancy by adding to the thermoplastic starch composite a flame retardant including chitosan and ammonium polyphosphate as main component. Accordingly, the flame-retardant composite fabric of the present invention has the effect of being suitable for use for fireproof clothing having excellent tensile strength, excellent tensile modulus and strong flame retardancy, etc.

BEST MODE

Preferred embodiments of a flame-retardant composite fabric according to the present invention and a preparing method therefor will be described with reference to FIGS. 1 to 6 below.

First, a flame-retardant composite fabric according to an embodiment of the present invention is mainly characterized in that it is a fabric prepared by applying to the surface of a flax fabric a mixture of a powdery flame retardant and a thermoplastic starch composite including corn starch as a main component and then subjecting the fabric to compression molding using a hot press.

The corn starch that is used in the present invention has advantages in that it is completely recyclable and biodegradable, it is physically and chemically easily changeable, and it is inexpensive and readily available. In addition, the corn starch has advantages in that it has good stability and strong adhesive strength, it can be formed into fine particles, and thus it can be formed into a plastic resin by hydrogen bonding with the hydroxyl group of water and glycerol.

In addition, the flax fabric has advantages in that it is environmentally friendly and it has excellent strength due to spiral cellulose bonded in a matrix form.

Therefore, in an embodiment of the present invention, a thermoplastic starch composite including corn starch as a main component is applied to a flax fabric, thereby preparing an environmentally friendly, biodegradable composite fabric. Accordingly, the prepared composite fabric does not cause environmental pollution, and can exhibit sufficient strength due to the characteristics of the flax fabric.

Figure 1:
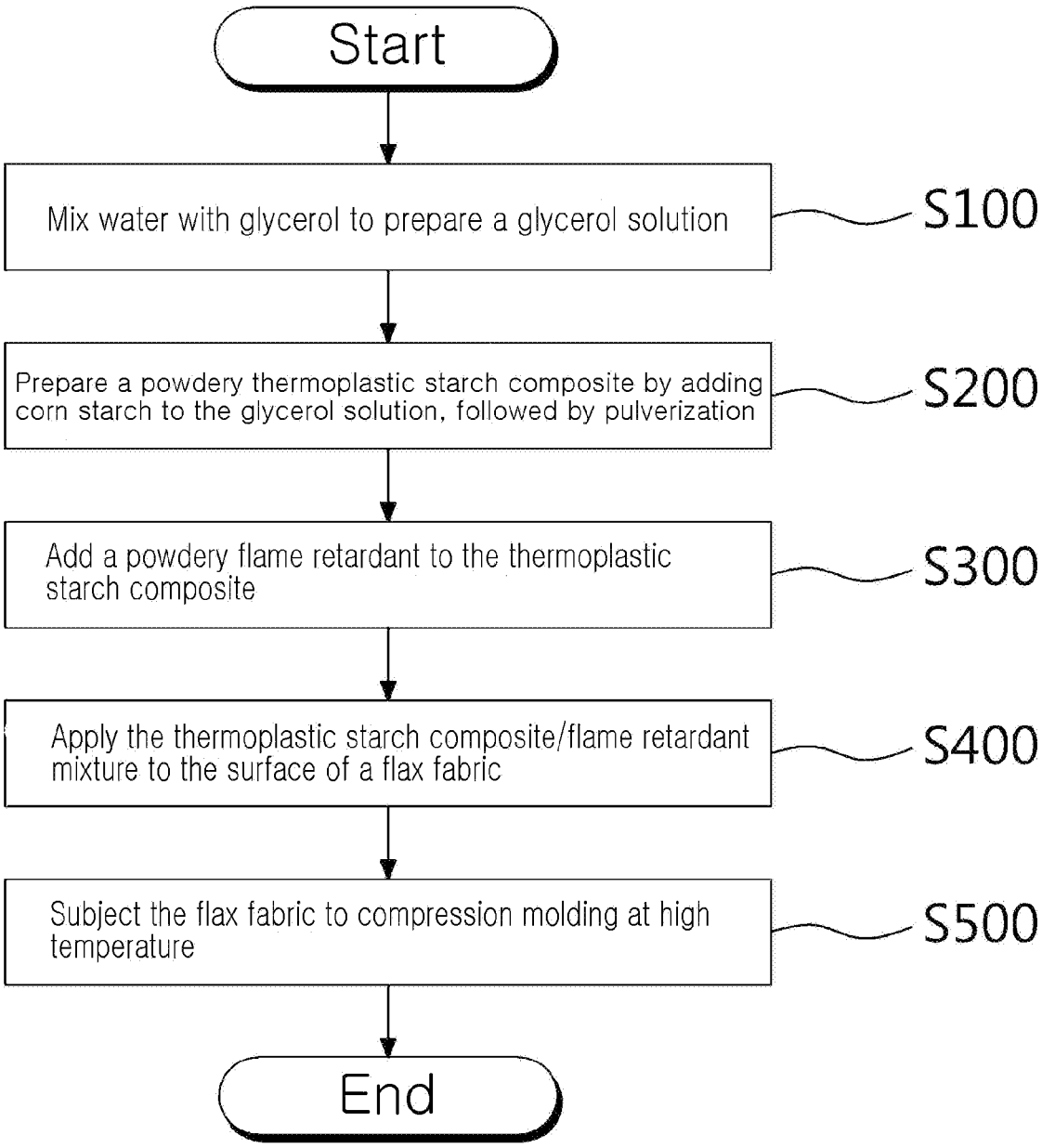
FIG. 1 is a flow chart showing a process for preparing a flame-retardant composite fabric according to an embodiment of the present invention.
Figure 2:
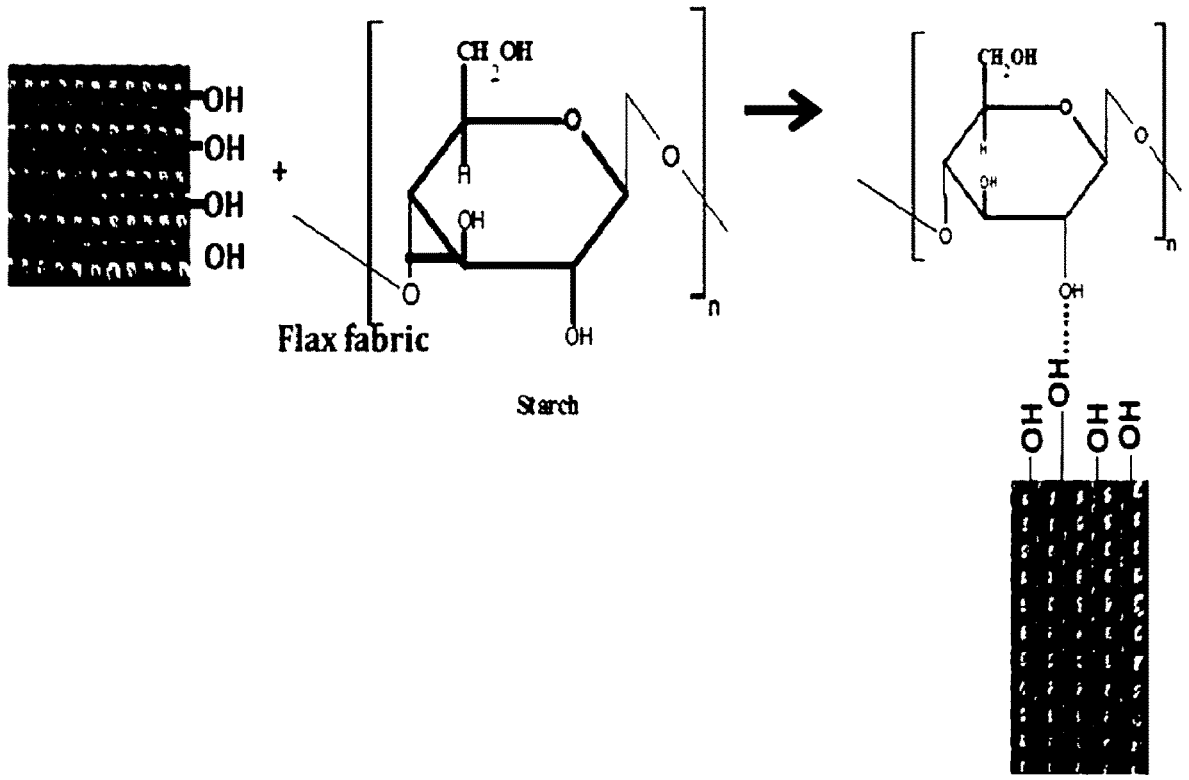
FIG. 2 shows the molecular structure of a flame-retardant composite fabric prepared by a process for preparing a flame-retardant composite fabric according to an embodiment of the present invention.

Namely, as can be seen in FIG. 2, a flame-retardant composite fabric according to an embodiment of the present invention, which is made of a combination of the thermoplastic starch composite and the flax fabric, is very stable in terms of its molecular structure.

In particular, in the embodiment of the present invention, a flame retardant is added to the thermoplastic starch composite so that flame retardancy can be further imparted to the composite fabric.

The flame retardant that is used in the present invention includes a mixture of chitosan and ammonium polyphosphate. The chitosan that is used as a main component in the flame retardant has a flame retardant effect, and the ammonium polyphosphate has acidic and foaming properties. Accordingly, the use of the chitosan in combination with the ammonium polyphosphate can exhibit a sufficient flame-retardant effect.

A method for preparing the flame-retardant composite fabric according to the above-described embodiment of the present invention will be described below.

The method for preparing the flame-retardant composite fabric according to the embodiment of the present invention includes a solution preparation step S100, a composite preparation step S200, a flame retardant addition step S300, a powder application step S400, and a hot-press molding step S500.

Namely, in the method for preparing the flame-retardant composite fabric according to the embodiment of the present invention, a powdery thermoplastic starch composite including corn starch as a main component is prepared, and then mixed with a flame retardant. The mixture is applied to a flax fabric and molded at high temperature and high pressure so that the thermoplastic starch composite containing the flame retardant can be very uniformly and accurately applied onto the overall surface of the flax fabric, thereby providing a flame-retardant composite fabric.

Each step of the method according to the present invention will be described in more detail below.

First, the solution preparation step S100 is a step of preparing a solution for mixture with corn starch.

In the solution preparation step S100, water (preferably distilled water) and glycerol are uniformly mixed with each other while they are heated at a temperature of 60 to 80° C., thereby preparing a glycerol solution.

This glycerol solution serves to provide an adhesive property while being melted by high-temperature heat in the hot-press molding step S500 to be described later, and also serves to increase processability and uniformly and firmly cure the thermoplastic starch composite after the completion of molding.

Next, the composite preparation step S200 is a step of preparing a thermoplastic starch composite by mixing corn starch with the glycerol solution prepared in the solution preparation step S100.

In this composite preparation step S200, powdery corn starch is added to the glycerol solution and stirred continuously to form a uniform mixture. Then, the mixture is allowed to stand for about 12 hours or more until it is cured. After the completion of the curing, the mixture is finely ground using a ball mill, thereby preparing a powdery thermoplastic starch composite. In this step, the glycerol solution contains the corn starch heated to a high temperature of 60 to 80° C., and thus enables the corn starch to be mixed more smoothly and completely than mixing corn starch at low temperatures.

Next, the flame retardant addition step S300 is a step of adding a flame retardant to the thermoplastic starch composite prepared in the composite preparation step S200, thereby imparting flame retardancy to the thermoplastic starch composite.

This flame retardant addition step S300 is performed by adding a powdery flame retardant, prepared by mixing chitosan with ammonium polyphosphate, to the powdery thermoplastic starch composite prepared in the composite preparation step S200, thereby preparing a mixture.

The chitosan that is used in the present invention exhibits an excellent effect of retarding flame, and the ammonium polyphosphate has both acidic and foaming properties. Accordingly, when the chitosan is used together with the ammonium polyphosphate to prepare a flame retardant and this flame retardant is added to the thermoplastic starch composite, a flame-retardant thermoplastic starch composite can be prepared.

Figure 3:
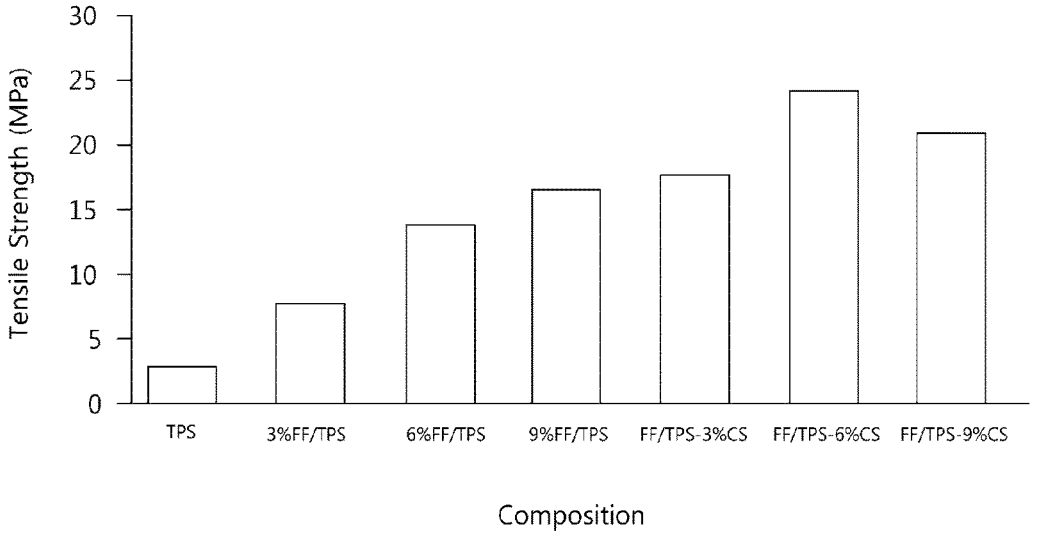
FIG. 3 is a graph showing the tensile strength of a flame-retardant composite fabric prepared by a process for preparing a flame-retardant composite fabric according to an embodiment of the present invention.
Figure 4:
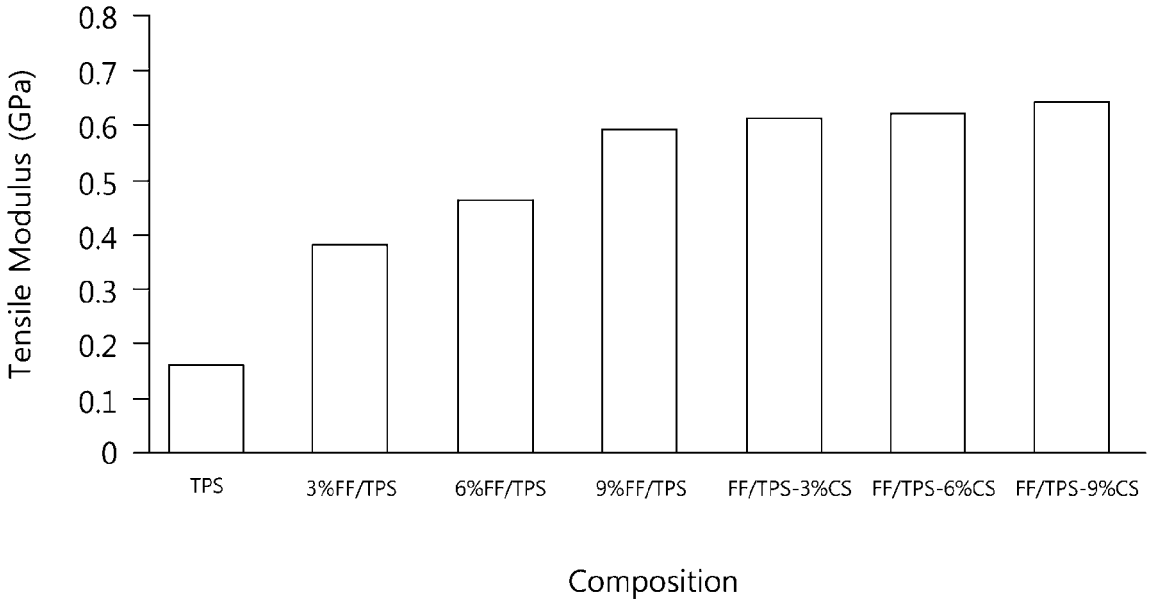
FIG. 4 is a graph showing the tensile modulus of a flame-retardant composite fabric prepared by a process for preparing a flame-retardant composite fabric according to an embodiment of the present invention.
Figure 5:
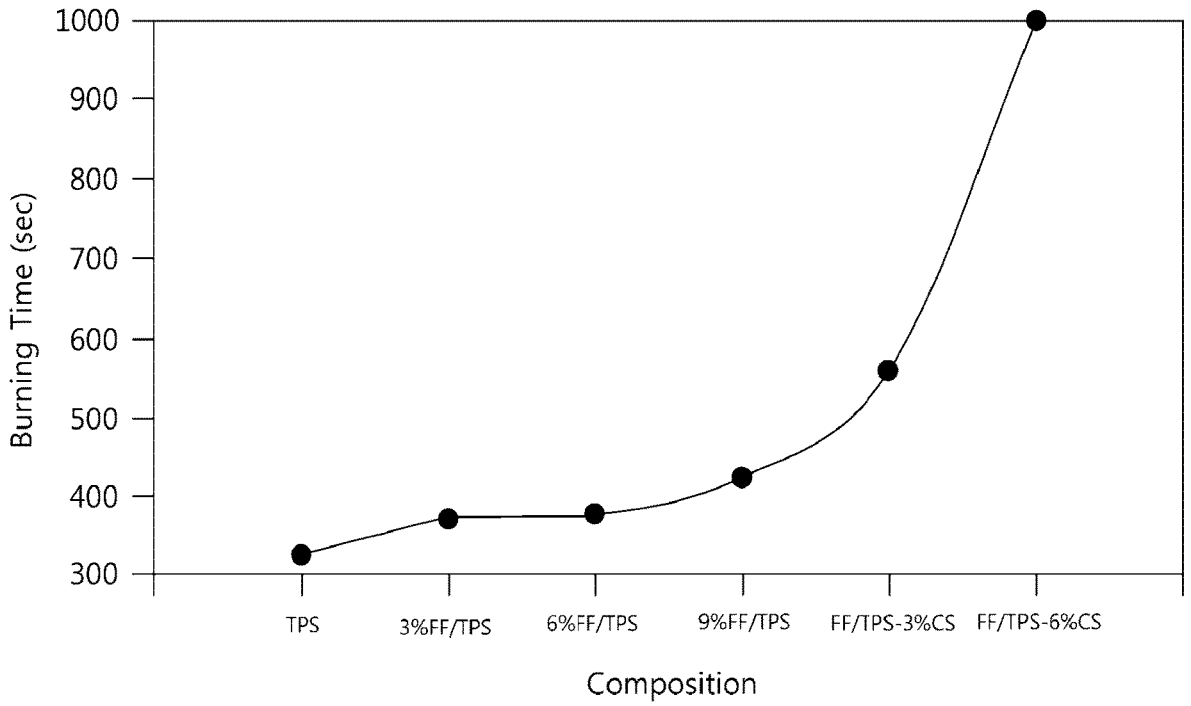
FIG. 5 is a graph showing the burning time of a flame-retardant composite fabric prepared by a process for preparing a flame-retardant composite fabric according to an embodiment of the present invention.
Figure 6:
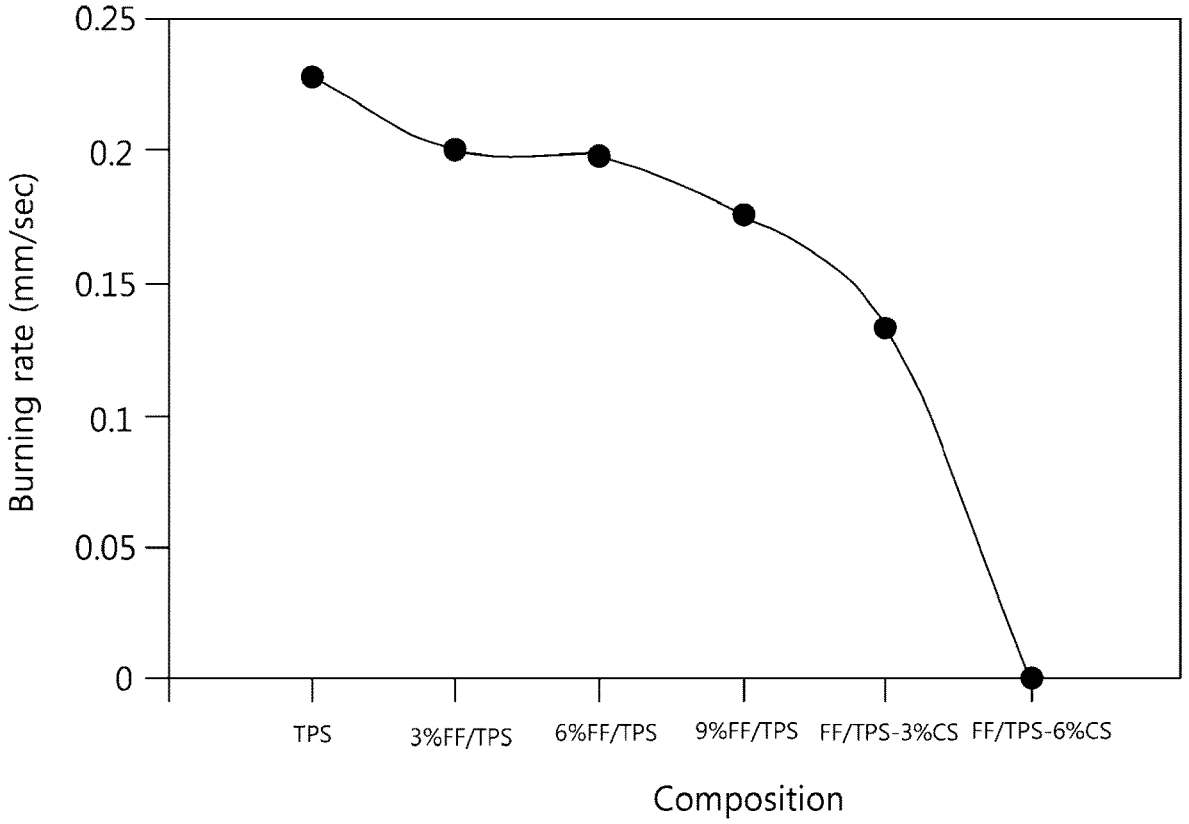
FIG. 6 is a graph showing the burning rate of a flame-retardant composite fabric prepared by a process for preparing a flame-retardant composite fabric according to an embodiment of the present invention.

In particular, the flame retardant is preferably added in an amount of 3 to 9 parts by weight based on the total weight of the final flame-retardant composite fabric. As shown in FIGS. 3 and 4, if the amount of flame retardant added is smaller than 3 parts by weight or larger than 9 parts by weight, a problem may arise in that the tensile strength and tensile modulus of the resulting flame-retardant composite fabric decrease rather than increasing, due to the excessive content of chitosan or ammonium polyphosphate. In addition, as shown in FIGS. 5 and 6, if the amount of flame retardant added is smaller than 3 parts by weight, the burning time of the resulting flame-retardant composite fabric becomes shorter. If the amount of flame retardant added is larger than 6 parts by weight, excellent flame retardancy can be obtained regardless of the content of the flame retardant. For these reasons, in view of all the tensile strength, tensile modulus, burning time and burning rate of the resulting flame-retardant composite fabric, the flame retardant is preferably added in an amount of 3 to 9 parts by weight, more preferably 6 parts by weight.

FIGS. 3 to 6 are graphs showing comparisons among a state in which a thermoplastic starch composite was present alone, a state in which 3 to 9 wt % of a flax fabric was added to the thermoplastic starch composite, and a state in which a flax fabric and 3 to 9 wt % of a flame retardant were added to the thermoplastic starch composite.

Next, the powder application step S400 is a step of applying to the surface of a sheet-like flax fabric the powdery thermoplastic starch composite to which the flame retardant was added in the flame retardant addition step S300.

This step is performed such that the powdery thermoplastic starch composite can be applied uniformly to the overall surface of the flax fabric.

Next, the hot-press molding step S500 is a step of subjecting the flax fabric, which has the thermoplastic starch composite powder applied thereto, to compression molding.

This hot-press molding step S500 is performed by placing on a compression mold the flax fabric having the thermoplastic starch composite applied thereto, and then pressing the flax fabric at a pressure of 7 MPa or higher and at a temperature of 120 to 160° C. In this compression-molding temperature range, the thermoplastic starch composite can be applied uniformly to the flax fabric in a melted state while the flax fabric or the thermoplastic starch composite containing the flame retardant is not burned.

In addition, in order to prepare a more durable composite fabric, two or more sheets of the flax fabric having the thermoplastic composite fabric applied thereto may be stacked on each other while they are arranged in different weaving directions.

In addition, the compression molding of the flax fabric may also be performed by providing a vacuum bag on the compression mold, stacking in the vacuum bag the flax fabric having the thermoplastic starch composite applied thereto, sealing the vacuum bag, and then performing molding at the above-described temperature and pressure in a vacuum state.

After the completion of the hot-press molding step S500, the compression mold is cooled to room temperature, and then allowed to stand so as to cure the thermoplastic starch composite, thereby obtaining the flame-retardant composite fabric according to the embodiment of the present invention.

An example of a process of preparing a flame-retardant composite fabric according to the above-described inventive method for preparing the flame-retardant composite fabric will be described below.

Example 1

1. Preparation of Glycerol Solution

First, 45 ml of glycerol and 20 ml of distilled water are mixed uniformly with each other while they are heated at a temperature of about 60 to 80° C., thereby preparing a glycerol solution.

2. Preparation of Thermoplastic Starch Composite 150 g of powdery corn starch and the prepared high-temperature glycerol solution are added to each other, and are continuously and repeatedly mixed for about 2 hours by using ball mixing technology.

Thereafter, a flame retardant is added to the glycerol solution mixed with the corn starch, followed by additional stirring for about 1 hour.

Thereafter, the mixture is allowed to stand at room temperature for 12 hours, and then ground into fine powder, thereby obtaining a thermoplastic starch composite.

3. Application of Powder

Flax fabric pieces, each having a size of 120×120 mm, are placed on a mold for compression molding, and the prepared powdery thermoplastic starch composite is applied to the surface of the flax fabric.

In this step, three sheets of the flax fabric are stacked on one another to form a sandwich structure, and the thermoplastic starch complex is applied not only to the surface of each flax fabric sheet but also between the flax fabric sheets.

4. Hot-Press Molding

The mold is preheated at a temperature of 140° C. for 10 minutes, and then heated to a temperature of 160° C., and the flax fabric is compression-molded at that temperature and at 7 MPa for 30 minutes.

5. Cooling and Mold Release

Thereafter, the heating of the compression mold is stopped, and the compression mold is cooled to room temperature by allowing it to stand. Thereafter, the resulting composite fabric is released from the mold, thus obtaining a flame-retardant composite fabric.

6. Tests for Tensile Strength and Tensile Modulus

In order to measure the physical properties of the prepared flame-retardant composite fabric, tests for tensile strength and tensile modulus were performed. The tests were performed on each of a pure thermoplastic starch composite, a thermoplastic starch composite to which 3 to 9 wt % of a flax fabric was added, and a thermoplastic starch composite to which 3 to 9 wt % of a flame retardant were added. The tensile strength and tensile modulus measured by the tests are shown in FIGS. 3 and 4.

7. Tests for Burning Time and Burning Rate

In addition, in order to measure the physical properties of the prepared flame-retardant composite fabric, additional tests for burning time and burning rate were performed. The tests were performed for each of a pure thermoplastic starch composite, a thermoplastic starch composite to which 3 to 9 wt % of a flax fabric was added, and a thermoplastic starch composite to which a flax fabric and 3 to 9 wt % of a flame retardant were added. The burning time and burning rate measured by the tests are shown in FIGS. 5 and 6.

As described above, the flame-retardant composite fabric of the present invention as described above and the preparing method therefor can provide an environmentally friendly composite fabric composed of biodegradable components.

In particular, the flame-retardant composite fabric of the present invention and the preparing method therefor can provide a physically and chemically more durable composite fabric including not only a thermoplastic starch composite containing corn starch as a main component, but also a flax fabric. Since the corn starch is readily available at low costs, it makes it possible to prepare a composite fabric having excellent performance at low production costs.

In addition, the flame-retardant composite fabric of the present invention and the preparing method therefor can provide a composite fabric imparted with flame retardancy as a result of adding to the thermoplastic starch composite a flame retardant including chitosan and ammonium polyphosphate as main components. Accordingly, the flame-retardant composite fabric of the present invention is suitable for use for fireproof clothing having excellent tensile strength, excellent tensile modulus and strong flame retardancy, etc.

The invention claimed is:

1. A method for preparing a flame-retardant composite fabric, the method comprising:

a solution preparation step of mixing water with glycerol while heating them at a temperature of 60 to 80° C., thereby preparing a glycerol solution;

a composite preparation step of adding powdery corn starch to the glycerol solution to obtain a glycerol/corn starch mixture, continuously stirring the glycerol/corn starch mixture, allowing the stirred glycerol/corn starch mixture to stand for a predetermined time, and then grinding the glycerol/corn starch mixture, thereby preparing a powdery thermoplastic starch composite;

a powder application step of applying the powdery thermoplastic starch composite to a surface of a flax fabric; and a hot-press molding step of subjecting the flax fabric with the thermoplastic starch composite applied thereto to compression molding using a hot press, thereby preparing the flame-retardant composite fabric.

2. The method of claim 1, further comprising, after the composite preparation step, a flame retardant addition step of adding a powdery flame retardant, prepared by mixing chitosan and ammonium polyphosphate together, to the powdery thermoplastic starch composite, prepared in the composite preparation step, to make a powdery thermoplastic starch composite/flame retardant mixture;

wherein the powder application step comprises applying the powdery thermoplastic starch composite/flame retardant mixture to the surface of the flax fabric.

3. The method of claim 2, wherein the flame retardant is added in an amount of 3 to 9 parts by weight based on the total weight of the flame-retardant composite fabric.

4. The method of claim 1, wherein the hot-press molding step is performed by stacking sheets of the flax fabric with the thermoplastic starch composite applied thereto on a compression mold and then pressing the sheets at a pressure of 7 MPa or higher and a temperature of 120 to 160° C.

* * * * *